US005475939A

United States Patent [19]

Salam

[11] Patent Number: 5,475,939

[45] Date of Patent: Dec. 19, 1995

[54] MATRIX DISPLAY DEVICE

[75] Inventor: Hassan P. A. Salam, London, England

[73] Assignee: Unisplay S.A., Geneva, Switzerland

[21] Appl. No.: 186,105

[22] Filed: Jan. 25, 1994

[30] Foreign Application Priority Data

Feb. 4, 1993 [GB] United Kingdom ..... 9302207

[51] Int. Cl.[6] ..... G09F 9/40

[52] U.S. Cl. ..... 40/449; 40/446; 40/492; 345/111

[58] Field of Search ..... 40/449, 450, 492, 40/497, 531, 533; 345/108, 111

[56] References Cited

U.S. PATENT DOCUMENTS

| | | | |
|---|---|---|---|
| 4,070,668 | 1/1978 | Kawaharada et al. | 40/449 X |
| 4,163,332 | 8/1979 | Salam | 40/449 |
| 4,819,357 | 4/1989 | Salam | 40/449 |
| 5,111,193 | 5/1992 | Huber et al. | 345/111 |
| 5,185,600 | 2/1993 | Salam | 40/449 X |
| 5,266,935 | 11/1993 | Wahlert | 345/111 X |

*Primary Examiner*—Kenneth J. Dorner
*Assistant Examiner*—James O. Hansen
*Attorney, Agent, or Firm*—Watson, Cole, Grindle & Watson

[57] ABSTRACT

An electromagnetic display matrix includes easily replaceable modules mounted on a panel that is fitted with electromagnets, each module carrying an array of rotatable reflective vanes and a display sheet having an array of back-lit diffusers. The display sheet is removable by sliding it on the surface of the module, and the module is removable by sliding it on the surface of the panel. Tabs are provided by which the module can be released from the panel.

12 Claims, 2 Drawing Sheets

MATRIX DISPLAY DEVICE

BACKGROUND OF THE INVENTION

This invention relates to electromagnetic displays of the type described in U.S. Pat. Nos. 4,163,332; 5,185,600 wherein each pixel comprises a shutter vane rotatable between a first position in which it covers a back-illuminated diffuser and the pixel appears dark and a second position in which the diffuser is exposed side by side with a reflective face of the vane and the pixel appears bright. Displays of this type include a matrix of electromagnets, the magnetic fields of which act upon magnets attached to the vanes so as to rotate the vanes. The vanes and diffusers provide the visual aspect of the display. For maximum brightness when viewed outdoors, the vanes and diffusers are preferably colored with fluorescent pigment, such as fluorescent yellow. Such pigment is subject to fading. In particular, the present invention is concerned with providing a display in which the components affecting the visual aspect are on replaceable modules each common to an array of pixels. The modules exclude connectors,wiring, electronic components and electromagnets.

DESCRIPTION OF THE PRIOR ART

Fig.1 illustrates a prior art display arrangement using a module 101 having an array of rotatable shutter vanes 102 and a display sheet 103, which provides the diffusers. Module 101 includes a fiberglass board 104 to which are fitted arrays of hinge brackets 105. Module 101 is attached to a fibreglass panel 106 by means of screws 108.

This arrangement has been found to have a number of disadvantages:

a) because of warpage of panel 106 and board 104, many screws are needed to ensure consistent spacing between electromagnet poles 109 and their respective magnets 107 on vanes 102;

b) the screws can work loose with repeated vibration of panel 106, caused by switching vanes 102 to and fro;

c) display sheet 103 bulges with wide temperature changes as a result of its thermal expansion relative to board 104. Because it is gripped by screws 108, display sheet 103 cannot slide on board 104 and its increase in length due to temperature change results in bulge 103*a*. This interferes with switching of vane 102 by acting as a springboard, causing the vane when reaching it to bounce back;

d) display sheet 103 cannot be removed from the matrix without taking module 101 off panel 106. This matters because display sheet 103 is subjected to ultraviolet light simultaneously from the fluorescent lamps at the back of the matrix and daylight at the front. As a result, it can fade more rapidly than the vanes and so need replacing when there is no need to replace the vanes;

e) display sheet 103 cannot be removed even from a removed module 101 without first removing all the vanes.

SUMMARY OF THE INVENTION

An object of the present invention is to provide a display with replaceable modules that overcomes the above listed disadvantages.

The invention provides a back-illuminated display matrix having horizontal and vertical rows of display elements comprising a base panel fitted with an array of electromagnet poles and an easily-replaceable module mounted on the front of the panel carrying a number of rotatable display, vanes each having coupled thereto a permanent magnet arranged to be opposite a corresponding one of the electromagnet poles. The module comprises a base sheet carrying at its front a display sheet using light-diffusing translucent material, and the module and the base panel include means engaging one with the other arranged to allow sliding movement of the module on the base panel between a first position in which the engagement means prevents removal of the module from the base panel and a second position in which the module is separable from the base panel, the display including inhibiting means arranged to hinder movement of the module from the first to the second position.

The invention also provides a back-illuminated display matrix having horizontal and vertical rows of display elements including an assembly comprising a base panel fitted with an array of electromagnet poles and a number of rotatable display vanes, each having coupled thereto a permanent magnet arranged to be opposite a corresponding one of the electromagnet poles, the display matrix including a display sheet having a number of light-diffusing translucent areas, and the assembly including means engaging the display sheet with the assembly arranged to allow sliding movement of the sheet on the assembly between a first position in which the engagement means prevents removal of the display sheet from the assembly and a second position in which the display sheet is removable from the assembly, the display matrix including inhibiting means arranged to hinder movement of the display sheet from the first to the second position.

The facility provided by the invention of being able to replace the visual components of a whole set of pixels as a single item or module in a simple and rapid way is of advantage not only for maintenance of matrixes using colors that fade, but also for maintenance of matrixes using pixels so small that they are difficult to handle compared with a module.

DESCRIPTION OF PREFERRED EMBODIMENTS

Figure 1:
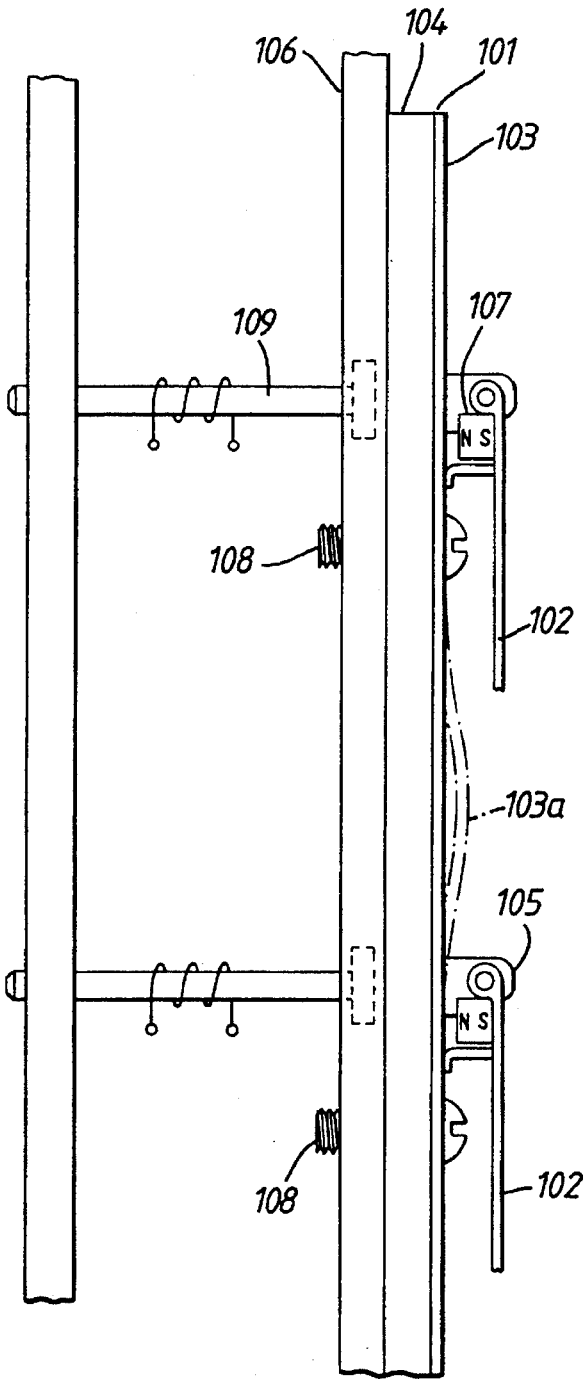
Fig.1 (PRIOR ART)
Fig. 1 is a side view of the previously mentioned prior-art arrangement of a module fitted to a panel.
Figure 3:
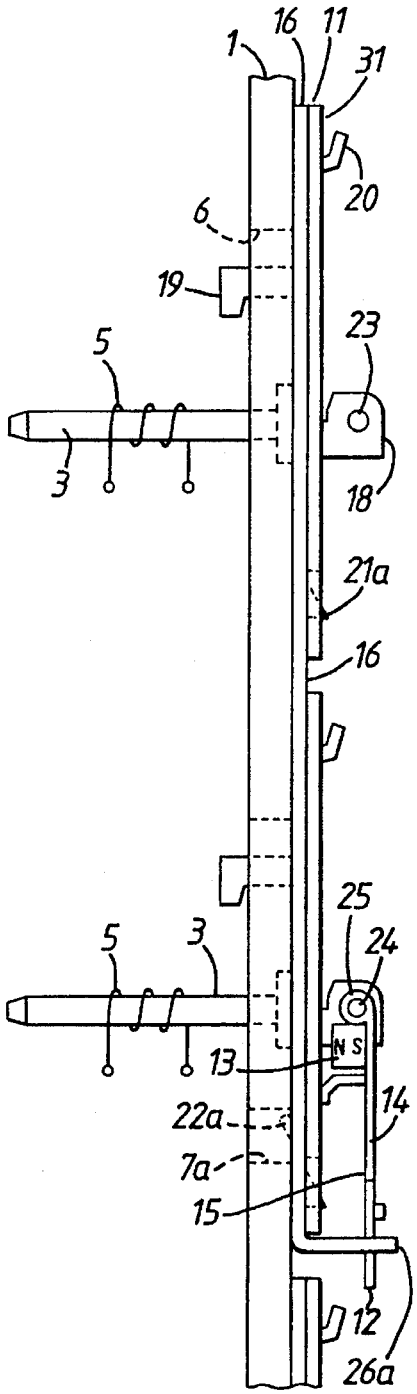
Fig. 3 is a side view of the arrangement in FIG. 1 with the replaceable module fitted onto the base panel.
Figure 2:
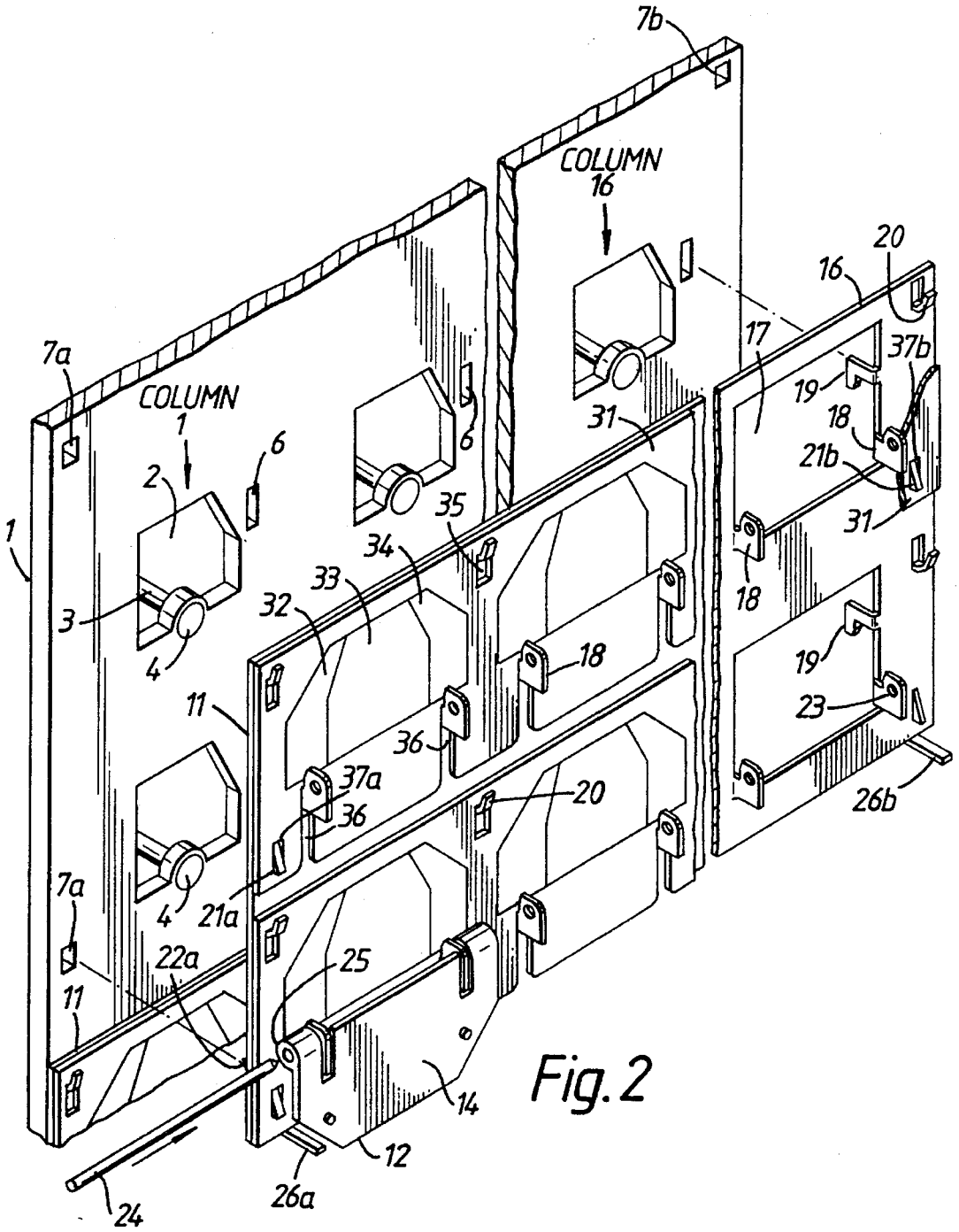
Fig. 2 illustrates in partly cut-away form a replaceable module and a corresponding base panel according to the invention.

Figs.2 and 3 illustrate a portion of a matrix according to the invention. Base panel 1 includes rows of pixel light-apertures 2 arranged to be back-lit by a common light source not shown. Attached to base panel 1 for each pixel is an electromagnet pole piece 3 having a flange 4. Pole piece 3 is staked into panel 1 and flange 4 is preferably countersunk into panel 1. Each pole piece 3 is surrounded by a coil 5. Base panel 1 can be of sixteen or more rows of pixels, with each row being of eight or sixteen pixels. A number of panels 1 may be butted sideways, vertically, or both ways to provide a complete sign. Panel 1 includes for each pixel a hole 6 and for each module 11 first and second holes 7*a* and 7*b*.

Panel 1 is arranged to carry a number of modules 11 which clip onto panel 1. FIG. 3 is a side view of the arrangement in Fig. 2 with module 11 clipped onto panel 1. Module 11 carries two rows of rotatable pixel vanes 12. Only one vane is shown, to simplify the illustration. Vane 12 carries a permanent magnet 13 which is acted upon by the field of the corresponding electromagnet pole piece 3 to rotate vane 12 clockwise or counterclockwise depending on the polarity of pulsed current applied to associated coil 5. Face 14 of vane 12 is arranged to be of a bright color, for example fluorescent yellow, and face 15 is arranged to be black. Vanes 12 of each row are hinged by a common rod 24 passed through bearings 25 in vanes 12 and holes 23 in brackets 18. The width of vanes 12 can be very nearly equal to the center-to-center distance of adjacent pixels.

Module 11 comprises a thin support sheet 16 of resilient material. Sheet 16 is preferably of non-magnetic stainless spring steel about 0.3 millimeters thick. Sheet 16 is press-formed to provide for each pixel a light-aperture 17, a pair of hinge brackets 18, each perforated with a hole 23 and extending from an edge of aperture 17, a rearwardly extending hook 19, and a forwardly extending hook 20. Hinge brackets 18 act as side bearings for vanes 12. Also, out of sheet 16 there is formed for each row of pixels first and second front catches 21*a*, 21*b* extending out of the front of sheet 16. Furthermore, extending out of the rear of sheet 16 there are formed first and second rear catches 22*a*, 22*b* of which only 22*a* is visible. Rear catch 22*b* is at the same height as catch 22*a* and next to the right hand edge of module 11. Module 11 also includes two tabs 22*a*, 26*b* protruding from its front which are integral parts of support sheet 16.

Mounted on the front of sheet 16 for each row of pixels is a thin sheet 31 of translucent material which is colored black all over its front face except for areas 32, 33, 34 repeated for each pixel. Area 33 is arranged to act as a diffuser reflecting ambient light and also passing light from aperture 2 to the viewer. Areas 32, 34 are arranged to be reflective. Areas 32, 33, 34 can be colored with fluorescent yellow pigment. The width of translucent diffuser portion 33 is roughly the same as that of aperture 2. The combined widths of areas 32, 33, 34 is appreciably greater than that of aperture 2 and can be made very nearly equal to the center-to-center distance of adjacent pixels, thus providing a large reflective area for the pixel. Areas 32, 33, 34 are hidden from the viewer when vane 12 is swung upwards by the electromagnet.

Display sheet 31 includes for each pixel a hole 35 close to the top edge of the sheet and a pair of slots 36, the slots being open at the bottom of sheet 31. Display sheet 31 also includes a hole 37*a* at the bottom left hand corner of the sheet and a hole 37*b* at the bottom right hand corner of the sheet. Display sheet 31 is fitted onto resilient sheet 16, retained on sheet 16 by hooks 20 which engage with holes 35, and by brackets 18 which also act as hooks, engaging with the closed ends of slots 36. Catches 21*a*, 21*b* nest in holes 37*a*, 37*b*, respectively, and hinder upward movement of display sheet 31. To release sheet 31 for replacement, its left and right hand bottom corners are prized away from sheet 16 so that holes 37*a*, 37*b* are clear of catches 21*a*, 21*b*, respectively, and sheet 31 is slid up and unhooked from sheet 16. Sheet 31 can be removed and replaced even when vanes 12 are fitted. Display sheet 31 can be 0.15 millimeters thick or more.

The connection of display sheet 31 to support sheet 16 is preferably arranged to allow some movement of sheet 31 parallel and relative to sheet 16 so that sheet 31 can expand horizontally and vertically relative to sheet 16 under the influence of ambient temperature changes without buckling or bulging. Bulges can interfere with the correct operation of the display by acting as springboards causing switched vanes to bounce back. To allow horizontal expansion, holes 35 are made slightly wider than hooks 20, slots 36 are made slightly wider than brackets 18 and hole 37*a* is made slightly wider than catch 21*a*. Sheet 31 is also arranged to have some slight freedom of motion in the vertical direction, of the order of 0.1 millimeters, to prevent slight changes in the vertical dimensions of the sheet, due to temperature changes, from causing buckling.

Module 11 is fastened onto panel 1 by hooks 19 which engage with holes 6 in panel 1 and by catches 22*a*, 22*b* which nest in holes 7*a*, 7*b*, respectively. Catches 22*a*, 22*b* inhibit upward movement of module 11. Catch 22*b* and its associated hole 7*b* are not visible in the drawings, but they are identical in shape and action to catch 22*a* and hole 7*a*, respectively, and placed next to tab 26*b*. To remove module 11 its left and right hand bottom corners are pulled using tabs 22*a*, 26*b* away from panel 1, so that catches 22*a*, 22*b* are outside holes 7*a*, 7*b*, respectively, and module 11 is slid up and unhooked off base panel 1.

Base panel 1 is preferably a fiberglass printed circuit board, 1.6 or 2.4 millimeters thick, to copper tracks of which coils 5 are electrically connected. Panel 1 can warp with time under the influence of fluctuating temperature and relative humidity, particularly if the display is used outdoors. However because of the flexibility of module 11 and the large number of places at which it is hooked to panel 1, the shape of module 11 conforms to any warpage of panel 1. Consequently the spacing between electromagnet 3 and magnet 13 is maintained substantially the same for all pixels. Correct equal spacing is desirable since it enables all pixels to operate with the same value of coil current, giving consistent operation of all the pixels.

Module 11 may itself not be flat, but again, because of its flexibility and because of the arrays of profusely provided hooks 19 and corresponding holes 6, module 11 conforms closely to the shape of panel 1 and so the correct spacings between electromagnets 3 and their respective permanent magnets 13 are maintained.

I claim:

1. A back-illuminated display matrix comprising a base panel fitted with an array of electromagnet poles and a module replaceably mounted on the front of said panel carrying a number of rotatable display vanes each vane having coupled thereto a permanent magnet arranged to be opposite a corresponding one of said electromagnet poles, said module comprising a base sheet carrying at a front thereon a display sheet comprising light-diffusing translucent material, said module and said base panel including means engaging one with the other for allowing sliding movement of said module on said base panel between a first position in which said engagement means prevents removal of said module from said base panel and a second position in which said module is separable from said base panel, said display matrix including inhibiting means for hindering movement of said module from said first to said second position.

2. A display matrix according to claim 1 wherein said display sheet is free to expand relative to said base sheet.

3. A display matrix according to claim 1 wherein said module carries at least one row of vanes.

4. A display matrix according to claim 1 wherein said display sheet is removable from said display matrix without removing the vanes associated with the base sheet.

5. A display matrix according to claim 1 wherein said engaging means comprises several identically oriented hooks, each hook coupling a portion of said module with a corresponding portion of said base panel.

6. A display matrix according to claim 1 wherein said inhibiting means comprises a catch releasable by moving a portion of said base sheet adjacent to said catch away from said base panel.

7. A display matrix according to claim 6 wherein said module is provided with a tab adjacent to said catch.

8. A back-illuminated display matrix comprising a base panel fitted with an array of electromagnet poles and a module replaceably mounted on the front of said panel carrying a number of rotatable display vanes each vane having coupled thereto a permanent magnet arranged to be opposite a corresponding one of said electromagnet poles, said module comprising an array of translucent diffusers, said module and said base panel including means engaging one with the other for allowing sliding movement of said module on said base panel between a first position in which said engagement means prevents removal of said module from said base panel and a second position in which said module is separable from said base panel, said display matrix including inhibiting means for hindering movement of said module from said first to said second position.

9. A back-illuminated display matrix including an assembly comprising a base panel fitted with an array of electromagnet poles and a number of rotatable display vanes, each vane having coupled thereto a permanent magnet arranged to be opposite a corresponding one of said electromagnet poles, said display matrix including a display sheet having a number of light-diffusing translucent areas, said assembly including means engaging said display sheet with said assembly for allowing sliding movement of said sheet on said assembly between a first position in which said engagement means prevents removal of said display sheet from said assembly and a second position in which said display sheet is removable from said assembly, said display matrix including inhibiting means for hindering movement of said display sheet from said first to said second position.

10. A display matrix according to claim 9 wherein said display sheet is free to expand relative to said base panel.

11. A display matrix according to claim 9 wherein said display sheet includes a row of holes close to an outer edge thereof and said assembly includes a row of hooks for engaging with said holes.

12. A display matrix according to claim 9 wherein said inhibiting means comprises a catch releasable by moving a portion of said display sheet adjacent to said catch in a direction away from said base panel.

* * * * *